United States Patent [19]

Kauffman

[11] Patent Number: 4,692,566

[45] Date of Patent: Sep. 8, 1987

[54] RIBBON CABLE

[75] Inventor: John C. Kauffman, Fort Wayne, Ind.

[73] Assignee: Phelps Dodge Industries, Inc., New York, N.Y.

[21] Appl. No.: 634,040

[22] Filed: Jul. 24, 1984

[51] Int. Cl.[4] ..... H01B 7/08

[52] U.S. Cl. ..... 174/117 FF; 174/72 TR; 174/117 F; 174/117 PC

[58] Field of Search ..... 174/34, 72 A, 72 TR, 174/117 R, 117 F, 117 FF, 117 PC, 126 S, 128 S

[56] References Cited

U.S. PATENT DOCUMENTS

| | | | |
|---|---|---|---|
| 3,005,739 | 10/1961 | Lang et al. | 174/117 F |
| 3,168,617 | 2/1965 | Richter | 174/117 FF |
| 3,612,743 | 10/1971 | Angele | 174/117 FF X |
| 3,891,955 | 6/1975 | Horton, III | 174/117 FF X |
| 4,098,628 | 7/1978 | Walton | 174/117 F X |
| 4,210,773 | 7/1980 | Haley et al. | 174/72 A |
| 4,356,345 | 10/1982 | Gonia | 174/117 F |
| 4,367,585 | 1/1983 | Elliott et al. | 174/117 F X |
| 4,370,548 | 1/1983 | Nagasawa et al. | 174/117 R X |
| 4,431,860 | 2/1984 | Perco et al. | 174/34 |
| 4,439,256 | 3/1984 | Meserve | 174/34 X |

FOREIGN PATENT DOCUMENTS

| | | | |
|---|---|---|---|
| 515052 | 12/1930 | Fed. Rep. of Germany | 174/72 TR |
| 2018774 | 11/1971 | Fed. Rep. of Germany | 174/117 FF |
| 1790215 | 1/1972 | Fed. Rep. of Germany | 174/117 R |
| 2446532 | 9/1980 | France | 174/72 A |
| 382329 | 10/1932 | United Kingdom | 174/72 TR |
| 651950 | 4/1951 | United Kingdom | 174/34 |

*Primary Examiner*—Morris H. Nimmo

*Attorney, Agent, or Firm*—Lundy and Walker

[57] ABSTRACT

An improved ribbon cable comprising a plurality of insulated wires in a fixed relationship to each other. The conductors have an axis in a common plane, and extend the full length of the cable. The conductors are bonded to a ribbon of flexible insulation material in a spaced apart relation with the longitudinal axes of the ribbon material and the conductors generally parallel to each other. In specific embodiments, the conductors may be foil, strips or depositions of conductive material. In other specific embodiments, a coating of flexible insulation material is superimposed on the ribbon material between the conductors and/or the conductors are overcoated with a continuous and uniform coat of flexible insulation or bonding material. An improved transposed ribbon cable is also provided.

19 Claims, 5 Drawing Figures

RIBBON CABLE

BACKGROUND OF THE INVENTION

The present invention relates to electrical cable and particularly to ribbon cables in which insulated conductors extend the full length of the cable in a fixed relationship to each other and transposed ribbon cables.

Electrical cables in a variety of configurations have been available for an extended period of time. One of those varieties is ribbon cable. In ribbon cable, a plurality of conductors are disposed side by side to yield a cable with a roughly rectangular cross-section as opposed to the round cross-section of ordinary cables. The rectangular cross-section permits the use of the ribbon cable in applications where one or two dimensions are constrained.

In transformer design, greater energy efficiency is achieved by using ribbon cable. Load losses can be reduced by using transposed ribbon cable. Similar benefits and similar energy efficiencies can be achieved in rotating electromagnetic device design using ribbon cables and transposed ribbon cables.

It is therefore highly desirable to provide an improved ribbon cable, an improved ribbon cable with improved dimensional characteristics, an improved ribbon cable having better shape characteristics, an improved ribbon cable which can be manufactured at a lower cost and at faster production speed, and an improved ribbon cable having all of the above advantages, and an approved transposed ribbon cable.

SUMMARY OF THE INVENTION

It is an object of the invention to provide an improved ribbon cable.

Another object of the invention is to provide an improved ribbon cable which has improved dimensional characteristics.

Another object of the invention is to provide an improved ribbon cable which has improved shape characteristics.

Another object of the invention is to provide an improved ribbon cable which is capable of faster production speeds.

Another object of the invention is to provide an improved ribbon cable which can be manufactured at a lower cost.

Further, an object of the invention is to provide an improved ribbon cable which has all of the above desired features.

Finally, an object of the invention is to provide an approved transposed ribbon cable.

In the broader aspects of the invention there is provided an improved ribbon cable comprising a plurality of insulated wires in a fixed relationship to each other. The conductors each have an axis in a common plane, and extend the full length of the cable. The conductors are bonded to a ribbon of flexible insulation material in a spaced apart relation with the longitudinal axes of the ribbon material and the conductors generally parallel to each other. In specific embodiments, the conductors may be foil, strips or depositions of conductive material. In other specific embodiments, a coating of flexible insulation material is superimposed on the ribbon material between the conductors and/or the conductors are overcoated with a continuous and uniform coat of flexible insulation or bonding material. An improved transposed ribbon cable is also provided.

BRIEF DESCRIPTION OF THE DRAWINGS

The above-mentioned and other features and objects of this invention and the manner of obtaining them will become more apparent and the invention itself will be better understood by reference to the following description of a specific embodiment of the invention taken in conjunction with the accompanying drawing wherein.

DESCRIPTION OF THE SPECIFIC EMBODIMENT

Figure 1:
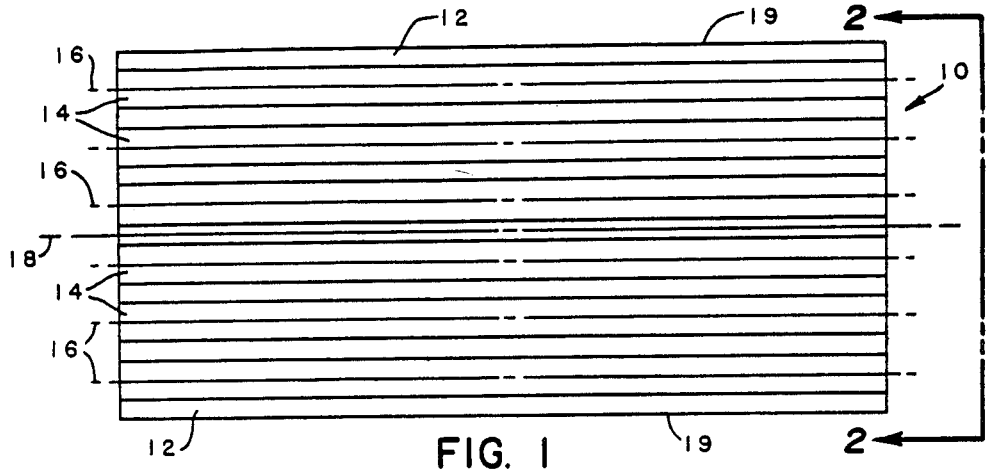
FIG. 1 is a top plan view of the ribbon cable of the invention.
Figure 2:
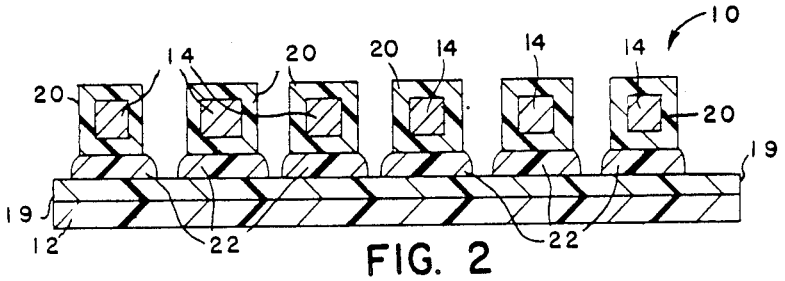
FIG. 2 is a a diagramatic cross-sectional of the improved ribbon cable of the invention shown in FIG. 1.

Referring to FIGS. 1 and 2, improved ribbon cable 10 of the invention is shown to comprise an elongated sheet or ribbon 12 of flexible insulation material and a plurality of elongated conductors 14 bonded to ribbon 12. Each of the conductors 14 has a longitudinally extending axis 16. The ribbon 12 has a longitudinally extending axis 18 and longitudinally extending boundaries 19. Axes 16 and 18 are parallel to each other.

In specific embodiments, conductors 14 may be magnet wire conductors having the dimensional characteristics as set forth in ANSI/NEMA MW1000 1977, Standards, conductive foil, conductive strips of conductive paint or depositions of metal or other conductive material.

With particular reference to FIG. 2, conductors 14 are shown to have superimposed thereon a continuous and concentric coat 20 of flexible insulation material. Insulated conductors 14 are bonded to ribbon 12 by a continuous and uniformly thick layer of bonding material 22 positioned between each conductor 14 and the ribbon 12. In the embodiment shown, the conductor to conductor insulation is provided by the ribbon 12, the superimposed coat 20 of insulation material, and by the spacing of the conductors 14. In other specific embodiments, more or less reliance may be placed on the spacing of the conductors 14 and the superimposed coat 20 of insulation material for the conductor to conductor insulation. In other words, the coat 20 can be provided in a variety of thickness or elimated, and the spacing between conductors 14 can be varied as desired for particular applications. Additionally, bonding material 22, in a specific embodiment, can be the same material as the insulation material of coat 20.

Figure 3:
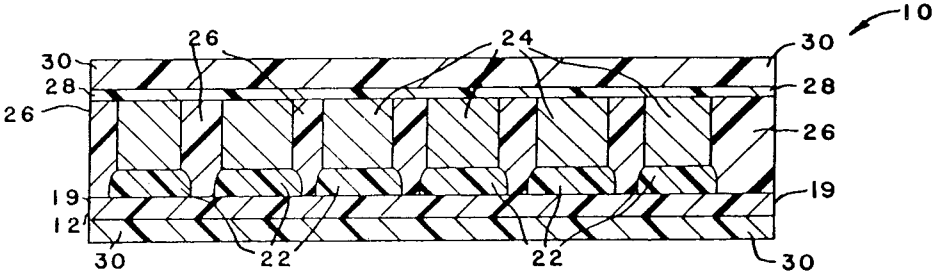
FIG. 3 is an a diagramatic cross-sectional like FIG. 2 of a modified ribbon cable of the invention.
Figure 5:
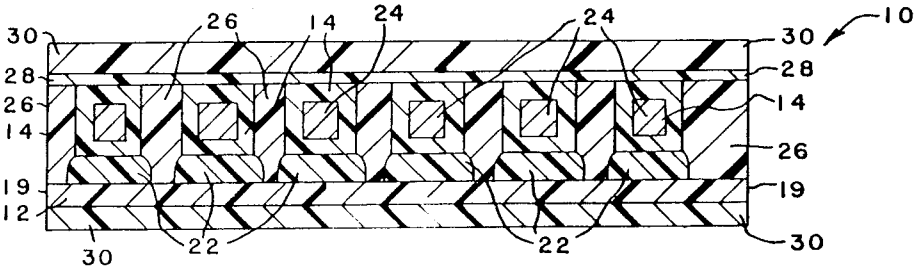
FIG. 5 is a diagramatic cross sectional view of a ribbon cable which may be folded to form the modified transposed ribbon cable of the invention.

Referring now to FIG. 3, still other specific embodiments of the invention will be described. Ribbon cable of FIG. 3 is shown to have a ribbon 12 on which a plurality of conductors 24 are positioned in a spaced apart relationship. The ribbon 12 is an elongated ribbon such as shown in FIG. 1 and conductors 24 extend the entire length of the ribbon. Conductors 24 and ribbon 12 each have a longitudinal axis and those axes 16, 18 are generally parallel to each other.

Conductors 24 may be any of the conductors above-described, with or without a coat 20 of insulation material. If conductors 24 are bare and the ribbon cable 10 of the invention is such as shown in FIG. 2, the conductor to conductor insulation must be provided by the spacing of the conductors. In the embodiment of the ribbon cable 10 shown in FIG. 3, additional insulation material 26 is positioned between conductors 24 and a uniformly thick and continuous coat 28 of insulation material is positioned on top of the conductors 24 and insulation 26. If desired, a uniform coat of bonding material 30 may be placed on ribbon 12 and/or on insulation coat 28, as desired.

The ribbon cable 10 of the invention can utilize ribbon 12 of any insulating sheet materials. Those existing at this time include Kapton, Nomex and Mylar materials sold by E. I. DuPont de Nemours & Company. Additionally, insulating material of coats 20, 26 and 28 and bonding material layer 22 and 30 can be of any magnet wire insulating material or bonding material, respectively. See for example those materials in ANSI/-NEMA NW1000 1977 Standards.

None of the embodiments illustrated in the drawings are drawn to scale because of the relatively small dimensions that are involved. Any of the dimensions of the conductors 14, 24, the dimensions of the coats 20, 22, 26, 28, 30, the dimensions of the ribbon 12, and their relation to each other may vary from application to application.

Figure 4:
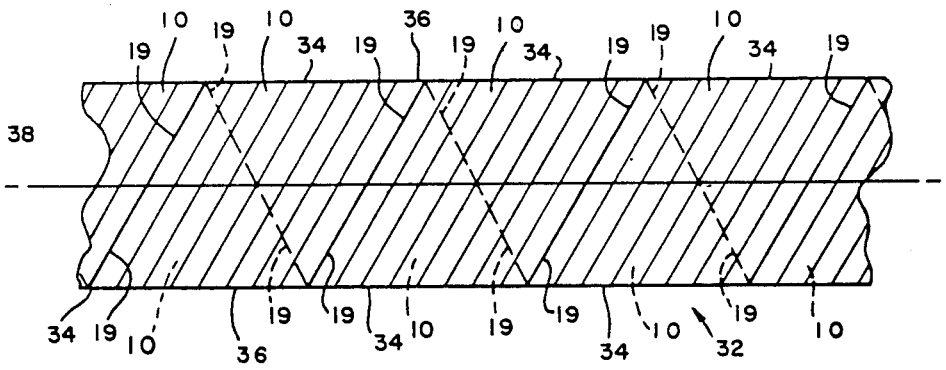
FIG. 4 is a top plan view of the ribbon cable as illustrated in FIGS. 1 and 2 folded to form the transposed ribbon cable of the invention.

Referring to FIG. 4, a transposed ribbon cable 32 is shown consisting of continuous length of ribbon 10 folded at folds 34 so as to position the longitudinal boundaries 19 of the folded portions contiguous with each other and to result in a folded ribbon cable having longitudinal boundaries 36 defined by the folds 32 and two layers of conductors 14 or 24 extending angularly to the longitudinal axis 38 of the folded ribbon cable 32. The angle at which the conductors 14 or 24 are disposed to the longitudinal axis 38 of the folded ribbon cable 32 can be any angle between 0 degrees and 90 degrees. Similiarly, the ribbon cable 10 can be any of the ribbon cables afore-described; however, if bare conductors are used, conductor to conductor insulation must be provided by placing insulation material 26 there between.

The transposed folded ribbon cable illustrated in FIG. 4 can be manufactured by any of the techniques disclosed in the concurrently filed U.S. patent application Ser. No. 634,041 entitled Ribbon Cable, Method And Apparatus And Electromagnetic Device of John C. Kauffman and Richard A. Westenfeld filed July 24, 1984, and U.S. patent application Ser. No. 634,042 entitled A Ribbon Cable, A Transposed Ribbon Cable And A Method and Apparatus For Manufacturing Ribbon Cable of Jessie H. Coon filed July 24, 1984 all assigned to Phelps Dodge Industries, Inc., which disclosures are incorporated herein by reference.

While a specific embodiment of the invention has been shown and described herein for purposes of illustration, it is desired that the protection afforded by any patent which may issue upon this application not be limited strictly to the disclosed embodiments; but that it extend to all structures and arrangements and methods and articles which contain the essence of the invention and which fall within the scope of the claims which are appended herein.

What is claimed is:

1. A ribbon cable comprising a ribbon of flexible insulation material, said ribbon having a longitudinal axis, a plurality of spaced, elongated conductors extending the full length of said cable, said conductors having axes in a common plane, each of said axes being generally parallel to said ribbon axis, said conductors being bonded to said ribbon, a continuous and uniform coat of flexible bonding material superimposed on said ribbon, said ribbon being between said conductors and said coat of bonding material, and a continuous and uniform first layer of flexible insulation material being superimposed on said ribbon between said conductors, said first layer being bonded to said ribbon and conductors.

2. A cable of claim 1 further comprising a continuous and uniform second layer of flexible insulating material superimposed on said conductors and said first layer of flexible insulating material.

3. The cable of claim 2 further comprising a continuous and uniform coat of bonding material superimposed on said second layer of insulating material.

4. The cable of claim 3 wherein said insulating material of said first and second layers is the same material as said bonding material.

5. The cable of claim 4 wherein said first layer and said second layer are applied as a single coat of insulating material.

6. The cable of claim 1 wherein said conductors are chosen from the group consisting of aluminum and copper conductors, conductive foils and strips, conductive paint, and depositions of conductive material, and wherein said bonding material is softenable.

7. The ribbon cable of claim 1 folded into a transposed ribbon cable, wherein said conductors are folded at the boundaries of said transposed ribbon cable to define folded portions, said portions being contiguous, and wherein said conductor axes are angularly disposed to the longitudinal axis of said transposed ribbon cable, said transposed ribbon cable having two layers of conductors, said conductors defining a plurality of laterally flattened juxtaposed helices, said helices having contiguous upper segments and contiguous lower segments, said upper segments being oblique to said longitudinal axis and at adjacent angles to said lower segments of said conductors, and said lower segments of said conductors being oblique to said longitudinal axis and at adjacent angles to said upper segments of said conductors, said upper segments being insulated from said lower segments.

8. A ribbon cable comprising a plurality of spaced elongated conductors extending the full length of said cable, said conductors each having an axis in a common plane, and an essentially continuous and concentric coat of flexible insulation material superimposed on said conductor, a ribbon of flexible insulation material extending the full length of said cable, said ribbon having an axis parallel to said conductor axes, said conductors being bonded to said ribbon, a continuous and uniform first layer of flexible insulating material superimposed on said ribbon between said conductors, a continuous and uniform second layer of flexible insulating material superimposed on said conductors and said first layer of flexible insulating material, and a continuous and uniform coat of bonding material superimposed on said second layer of insulating material.

9. The ribbon cable of claim 8 folded into a transposed ribbon cable, wherein said conductors are folded at the boundaries of said transposed ribbon cable to define folded portions, said folded portions being contiguous, and wherein said conductor axes are angularly disposed to the longitudinal axis of said transposed ribbon cable, said transposed ribbon cable having two layers of conductors, said conductors defining a plurality of laterally flattened juxtaposed helices, said helices having contiguous upper segments and contiguous lower segments, said upper segments being oblique to said longitudinal axis and at adjacent angles to said lower segments of said conductors, and said lower segments of said conductors being oblique to said longitudinal axis and at adjacent angles to said upper segments of said conductors, said upper segments being insulated from said lower segments.

10. The cable of claim 8 wherein said first layer and said second layer are applied as a single coat of insulating material.

11. A ribbon cable comprising a plurality of spaced elongated conductors extending the full length of said cable, said conductors each having an axis in a common plane, and an essentially continuous and concentric coat of flexible insulation material superimposed on said conductor, a ribbon of flexible insulation material extending the full length of said cable, said ribbon having an axis parallel to said conductor axes, said conductors being bonded to said ribbon, and a continuous and uniform coat of flexible bonding material superimposed on said ribbon, said ribbon being between said conductors and said coat of bonding material.

12. The ribbon cable of claim 11 folded into a transposed ribbon cable, wherein said conductors are folded at the boundaries of said transposed ribbon cable to define folded portions, said folded portions being contiguous, and wherein said conductor axes are angularly disposed to the longitudinal axis of said transposed ribbon cable, said transposed ribbon cable having two layers of conductors, said conductors defining a plurality of laterally flattened juxtaposed helices, said helices having contiguous upper segments and contiguous lower segments, said upper segments being oblique to said longitudinal axis and at adjacent angles to said lower segments of said conductors, and said lower segments of said conductors being oblique to said longitudinal axis and at adjacent angles to said upper segments of said conductors, said upper segments being insulated from said lower segments.

13. A ribbon cable comprising a plurality of spaced elongated conductors extending the full length of said cable, said conductors each having an axis in common plane, and an essentially continuous and concentric coat of flexible insulation material superimposed on said conductor, a ribbon of flexible insulation material extending the full length of said cable, said ribbon having an axis parallel to said conductor axes, said conductors being bonded to said ribbon, said ribbon cable being folded into a transposed ribbon cable, wherein said conductors are folded at the boundaries of said transposed ribbon cable to define folded portions, said folded portions being contiguous, and wherein said conductor axes are angularly disposed to the longitudinal axis of said transposed ribbon cable, said transposed ribbon cable having two layers of conductors, said conductors defining a plurality of laterally flattened, juxtaposed helices, said helice having contiguous upper segments and contiguous lower segments, said upper segments being oblique to said longitudinal axis and at adjacent angles to said lower segments of said conductors, and said lower segments of said conductors being oblique to said longtiudinal axis and at adjacent angles to said upper segments of said conductors, said upper segments being insulated from said lower segments.

14. The ribbon cable of claim 13 wherein said conductor layers are bonded together.

15. A ribbon cable comprising a ribbon of flexible insulation material, said ribbon having a longitudinal axis, a plurality of spaced, elongated conductors extending the full length of said cable, said conductors having axes in a common plane, each of said axes being generally parallel to said ribbon axis, said conductors being bonded to said ribbon, and a continuous and uniform first layer of flexible insulation material being superimposed on said ribbon between said conductors, said first layer being bonded to said ribbon and conductors, said ribbon cable being folded into a transposed ribbon cable, wherein said conductors are folded at the boundaries of said transposed ribbon cable to define folded portions, said folded portions being contiguous, and wherein said conductor axes are angularly disposed to the longitudinal axis of said transposed ribbon cable, said transposed ribbon cable having two layers of conductors, said conductors defining a plurality of laterally flattened, juxtaposed helices, said helices having a contiguous upper segments and contiguous lower segments, said upper segments being oblique to said longitudinal axis and at adjacent angles to said lower segments of said conductors, and said lower segments of said conductors being oblique to said longitudinal axis and at adjacent angles to said upper segments of said conductors, said upper segments being insulated from said lower segments.

16. The ribbon cable of claim 15 wherein said conductor layers are bonded together.

17. A ribbon cable comprising a ribbon of flexible insulation material, said ribbon having a longitudinal axis, a plurality of spaced, elongated conductors extending the full length of said cable, said conductors having axes in a common plane, each of said axes being generally parallel to said ribbon axis, said conductors being bonded to said ribbon, and a continuous and uniform first layer of flexible insulation material being superimposed on said ribbon between said conductors, said first layer being bonded to said ribbon and conductors, a continuous and uniform second layer of flexible insulating material superimposed on said conductors and said coat of flexible insulating material, and a continuous and uniform coat of bonding material superimposed on said second layer of insulating material.

18. The ribbon cable of claim 17 folded into a transposed ribbon cable, wherein said conductors are folded at the boundaries of said transposed ribbon cable to define folded portions, said folded portions being contiguous, and wherein said conductor axes are angularly disposed to the longitudinal axis of said transposed ribbon cable, said transposed ribbon cable having two layers of conductors, said conductors defining a plurality of laterally flattened juxtaposed helices, said helices having contiguous upper segments and contiguous lower segments, said upper segments being oblique to said longitudinal axis and at adjacent angles to said lower segments of said conductors, and said lower segments of said conductors being oblique to said longitudinal axis and at adjacent angles to said upper segments of said conductors, said upper segments being insulated from said lower segments.

19. The cable of claim 17 wherein said first layer and said second layer are applied as a single coat of insulating material.

* * * * *